US006342678B1

(12) United States Patent
Knop et al.

(10) Patent No.: US 6,342,678 B1
(45) **Date of Patent: *Jan. 29, 2002**

(54) LOW-CROSSTALK FLEXIBLE CABLE

(75) Inventors: Harald Knop, Berlin (DE); Daniel Prudhon, Saint Leu la Foret (FR)

(73) Assignee: Nexans, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,730

(22) Filed: Mar. 12, 1999

(30) Foreign Application Priority Data

Mar. 12, 1998 (FR) ..... 98 03052

(51) Int. Cl.[7] ..... H01B 11/06
(52) U.S. Cl. ..... 174/113 C; 174/116
(58) Field of Search ..... 174/113 R, 113 C, 174/131 A, 116, 36

(56) References Cited

U.S. PATENT DOCUMENTS

| | | | | | |
|---|---|---|---|---|---|
| 240,108 | A | * | 4/1881 | Eaton | 174/116 X |
| 3,843,831 | A | | 10/1974 | Hutchinson et al. | 174/116 |
| 3,993,860 | A | * | 11/1976 | Snow et al. | 174/116 X |
| 4,449,012 | A | * | 5/1984 | Voser | 174/113 C X |
| 4,590,328 | A | * | 5/1986 | Kunze | 174/116 X |
| 4,600,268 | A | * | 7/1986 | Spicer | 174/113 C X |
| 4,677,256 | A | * | 6/1987 | Bauer et al. | 174/113 R X |
| 5,574,250 | A | * | 11/1996 | Hardie et al. | 174/36 |
| 5,808,239 | A | * | 9/1998 | Olsson | 174/113 C |
| 5,952,615 | A | * | 9/1999 | Prudhon | 174/113 C |

FOREIGN PATENT DOCUMENTS

| | | |
|---|---|---|
| FR | 989 196 | 9/1951 |
| FR | 1 044 316 | 11/1953 |

OTHER PUBLICATIONS

Hawley, "Condensed Chemical Dictionary" pp. 921–922, 1981.*

* cited by examiner

*Primary Examiner*—Chau N. Nguyen
(74) *Attorney, Agent, or Firm*—Sughrue Mion, PLLC

(57) ABSTRACT

A cable includes a set of pairs of conductors isolated from each other to limit crosstalk between the pairs. The cable includes a flexible central cord. The pairs are separated by peripheral cords that are also flexible and distributed around the central cord. The assembly is surrounded by a sheath.

16 Claims, 1 Drawing Sheet

LOW-CROSSTALK FLEXIBLE CABLE

BACKGROUND OF THE INVENTION

1. Field of the Invention

The invention concerns a cable for transmitting information made up of electrical conductors.

2. Description of the Prior Art

Nowadays information is transmitted by electrical cables comprising a large number of conductors and at very high frequencies. The increase in the frequencies and the number of streams of information to be transmitted in parallel on different conductors leads to the need to provide effective isolation between the various electrical conductors grouped together in the same cable. The risk of crosstalk increases with the number of conductors and the frequency. Crosstalk occurs because information transmitted on one conductor is radiated toward another conductor.

Information is usually transmitted on pairs of conductors and to prevent crosstalk, or near-end crosstalk, the pairs are isolated from each other. They can also be shielded.

The most usual solution to the problem of shielding each pair of conductors is to wind a metal or metallized strip in a helix around each pair, the cable being formed by assembling the screened pairs within a common protective sheath. The operation of individually shielding the pairs is slow and difficult. Also, to connect the resulting cable the individual shielding of the pairs must be removed to obtain access to the conductors, which makes connection, which is usually carried out on site, difficult.

To remedy the above drawbacks a cable for transmitting information has already been proposed, in document FR-2 738 947, in which the electrical shielding of the various conductors, in particular the pairs of conductors, comprises a central member with radial fins separating the pairs from each other and providing partial shielding of each pair, and a peripheral shield around the central member and the pairs of conductors, the peripheral shield completing the shielding of each pair. However, it has been found that the fins on the central member act like reinforcing ribs, so that the resulting cable is unsuitable for many applications in which the cable is required to be flexible.

The invention provides a flexible cable that has good isolation between conductors or between pairs of conductors and which is also particularly simple to manufacture and to use.

SUMMARY OF THE INVENTION

In a first aspect the invention consists in a cable for transmitting information including a set of conductors or pairs or quads of conductors isolated from each other to limit crosstalk between said conductors, which cable includes a flexible central cord and in which cable said conductors or pairs or quads of conductors are separated by peripheral cords which are also flexible and distributed around the central cord, the assembly being surrounded by a sheath.

The cords are made from an insulative material such as polypropylene, for example.

The central cord and the peripheral cords delimit compartments separating the conductors or the pairs of conductors.

In the preferred embodiment the cords are deformable to constitute a filling of the cable. In this case the cords, which are originally circular in section, are deformed to fill the gaps between the conductors or pairs of conductors. This minimizes the overall size, i.e. the external diameter, of the cable.

The cords are fibers, for example.

The assembly is preferably surrounded by an external shield, such as a polyester tape covered with aluminum, and possibly a metal braid, for example a tinned copper braid. The external shield is covered with a jacket, for example of fireproof polyolefin.

The cords can be metallized to improve the shielding and therefore to increase the attenuation of crosstalk.

A cable of the above kind can be made with the machines usually employed, without it being necessary to modify the machines and without it being necessary to reduce the speed of manufacture. The cords are installed in the same manner as the conductors or pairs of conductors are assembled.

Also, the conductors have the same relative position at practically all times and so the spread in the electrical characteristics of the manufactured cables is limited. The position of the pairs of conductors relative to each other remains stable because of the damping effect of the filling consisting of the cords. Moreover, because of the flexibility of the cords and the simplicity of the structure, the cables are particularly rugged.

It has been found that, despite its simplicity, a structure of the above kind provides excellent crosstalk isolation between the conductors or pairs of conductors, as high as 50 dB at 200 MHz, and this even in the absence of shielding completely surrounding each pair of conductors.

In another aspect, the invention consists of a cable for transmitting information which includes at least one flexible and deformable cord so that, when the peripheral sheath surrounds the conductors (or pairs of conductors), the conductors exert a pressure forming compartments in which the conductors or pairs of conductors are lodged.

The cord can also comprise fibers. It can be metallized to constitute a shield, at the same time as the external shield.

Note that, regardless of the embodiment, compared to conventional cables the longitudinal regularity of the electrical impedance is improved, enabling the manufacture of larger twisted pairs than with conventional cables. The aim of twisting is to regularize the impedance in the longitudinal direction. The invention allows an average lay of 30 mm compared to an average lay, other things being equal, of 20 mm in a conventional cable. Manufacture can therefore be accelerated and the cable is easier to connect.

Other features and advantages of the invention will become apparent from the description of certain embodiments of the invention given with reference to the accompanying drawings.

DETAILED DESCRIPTION OF THE PREFERRED EMBODIMENTS

Figure 1:
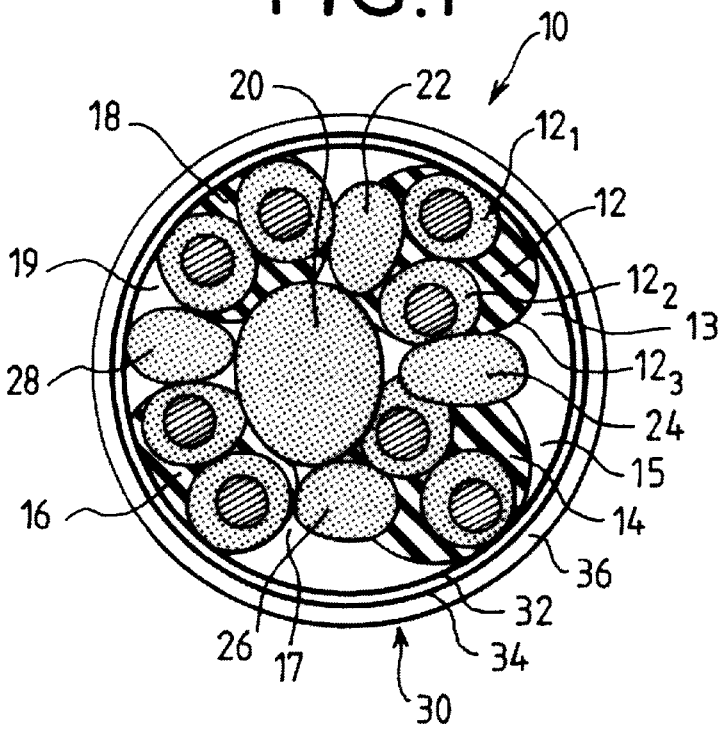
FIG. 1 shows a cable in accordance with the invention for transmitting information in cross section.

In the example shown in FIG. 1 the cable 10 for transmitting information comprises four pairs of conductors 12, 14, 16 and 18. Each pair, for example the pair 12, conventionally comprises two insulated conductors $\mathbf{12}_1$ and $\mathbf{12}_2$ and a sheath $\mathbf{12}_3$ surrounding the pair of conductors.

The pairs of conductors are isolated from each other by compartments 13, 15, 1 7 and 19 delimited by a central cord 20 and respective peripheral cords 22, 24, 26 and 28 pressed against the central cord. The central and peripheral cords are made of an insulative flexible material such as polypropylene. The cords are fibers in the example shown and are deformable.

In this example the central cord 20 has a circular section, before deformation, with a diameter in the order of 2.5 mm and the peripheral cords 22 to 28 also have a circular section, before deformation, with a smaller diameter, in the order of 1.5 mm.

During installation the peripheral cords 22 to 28 are pressed against the central cord 20. The assembly of the cords and the pairs of conductors is held in place by an external sheath 30. This comprises a polyester tape 32 covered with aluminum, a tinned copper braid 34 around the tape 32 and, finally, a fireproof polyolefin outer jacket 36. The cords have a circular section before assembly. When the tape 32 of the peripheral sheath is applied the conductors exert a pressure against the central cord and the peripheral cords. The cords therefore deform and partly fill the gaps or interstices between the pairs. The cords therefore constitute a filling which tends to be distributed within the volume inside the tape. The greater part of the volume is occupied by the pairs of conductors, which are less deformable. The outside diameter of the cable is therefore not determined by the original diameters of the central and peripheral cords.

The separation between the pairs of conductors minimizes crosstalk because coupling between pairs is reduced as the distance between pairs increases. In one example, in which each conductor has a copper core with a diameter of 0.51 mm and a polyethylene external insulation with a diameter of 1.1 mm, with a central cord originally having a diameter of 2.5 mm and peripheral cords originally having a diameter of 1.5 mm, it has been found that excellent transmission can be obtained with crosstalk of 50 dB at 200 MHz. The origin of such performance is the separation into compartments and the improved longitudinal regularity of the impedance.

The cable in accordance with the invention is easy to connect because it is no longer necessary to remove a tape from each pair or from each conductor. Most importantly, it is highly flexible because the separator members, consisting of the cords, are flexible.

A cable of the above kind can be manufactured using the same machines as those usually employed, because fitting a flexible cord is no different than fitting an insulated conductor or pair of conductors.

The relative distances between pairs are determined by the dimensions of the central cord and the peripheral cords. Accordingly there is no spread in the electrical characteristics of the cables because they depend on dimensions that can be controlled. Also, as mentioned hereinabove, the impedance is regular along the length of the cable.

The number of peripheral cords is at least equal to the number of pairs. It can also be greater than four.

A single conductor can be provided in each compartment, rather than a pair of conductors. A greater number of conductors can equally be provided in each compartment, for example a quad (four conductors).

The cable can be used for any type of application, and in particular where a flexible cable is required, for example between a wall jack and a device to be connected to it, such as a computer.

Figure 2:
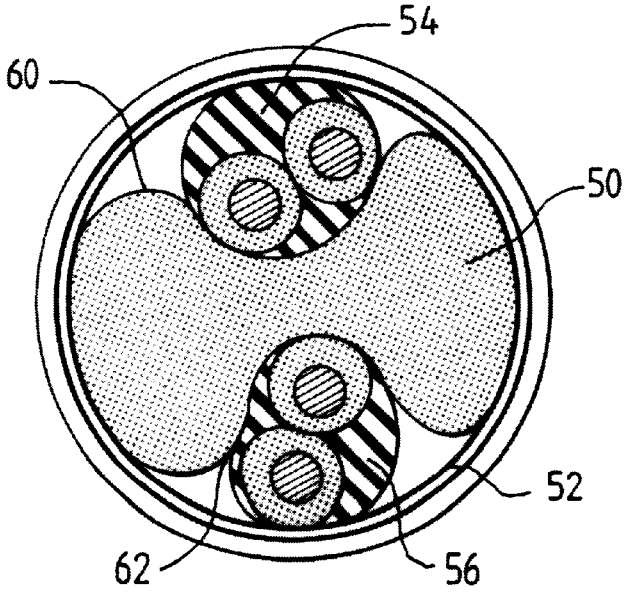
FIG. 2 is a view analogous to that of FIG. 1 showing a variant of the cable.

The embodiment of the invention shown in FIG. 2 differs from that shown in FIG. 1 in that there is only one deformable and flexible cord 50. When the peripheral sheath 52 is fitted around the assembly of the cord 50—which originally has a circular section—and the pairs of conductors 54 and 56, the pressure exerted by the sheath 52 on the pairs 54 and 56 is transmitted to the deformable cord 50 and forms compartments 60 and 62 in which the pairs 54 and 56 are held. Accordingly, the pairs 54 and 56 are isolated from each other and held in place, which procures the same advantages as in the FIG. 1 embodiment, namely minimized crosstalk, low spread of impedances in manufacture and regularity of impedance in the longitudinal direction in the same cable.

As in the FIG. 1 example, the cord 50 can be made from insulative fiber and metallized.

In both embodiments the cord(s) can also be made using textile fibers, for example dried cotton fibers. Drying limits the value of the dissipation factor. As a general rule, a non-polar material is used.

An extruded elastomer filling, in particular a silicone elastomer, can be used in place of the fiber cord(s).

What is claimed is:

1. A cable assembly for transmitting information at high frequencies, up to 200 MHz, said cable assembly comprising:

either a set of pairs of conductors wherein each of said pairs is isolated from the other of said pairs to limit cross talk between said pairs, or a set of quads of conductors wherein each of said quads is isolated from the other of said quads to limit cross talk between said quads;

a flexible central cord; and a plurality of flexible peripheral cords distributed around said central cord;

wherein said pairs or said quads are separated by said peripheral cords, and a sheath which surrounds the cable assembly.

2. The cable assembly claimed in claim 1, wherein at least one of said central cord and said peripheral cords is deformable.

3. The cable assembly claimed in claim 1, wherein at least one of said central cord and said peripheral cords is insulative.

4. The cable assembly claimed in claim 3, wherein either one of said central cord and said peripheral cords is made of an elastomer.

5. The cable assembly claimed in claim 4, wherein either one of said central cord and said peripheral cords is extruded.

6. The cable assembly claimed in claim 1, wherein said central cord and said peripheral cords comprise a plurality of fibers.

7. The cable assembly claimed in claim 4, wherein said fibers are textile fibers.

8. The cable assembly claimed in claim 7, wherein said textile fibers are dry.

9. The cable assembly claimed in claim 1, wherein a periphery of either one of said central cord and said peripheral cords is metallized.

10. The cable assembly claimed in claim 1, wherein said central cord has a cross-section larger than that of said peripheral cords.

11. The cable assembly claimed in claim 1, wherein said sheath includes a metal shield.

12. The cable assembly claimed in claim 11, wherein said shield includes a metallized plastics material tape.

13. The cable assembly claimed in claim 11, wherein said shield comprises a metal.

14. The cable assembly claimed in claim 1, in which there are four peripheral cords.

15. A cable assembly for transmitting information at high frequencies, up to 200 MHz, comprising:

either a set of pairs of conductors, wherein each of said pairs is isolated from the other of said pairs to limit cross talk between said pairs or a set of quads of conductors wherein each of said quads is isolated from the other of said quads to limit cross talk between said quads;

a peripheral sheath which surrounds said set of pairs or quads, and at least one cord which is flexible and deformable in an entire cross-section of said cord, so that when said peripheral sheath is applied, said pairs or quads, form compartments in said flexible cord, accommodating and separating said pairs or quads.

16. The cable assembly claimed in claim 15, wherein said deformable cord comprises a plurality of fibers.

* * * * *